US011220940B2

(12) United States Patent
Ishikawa

(10) Patent No.: US 11,220,940 B2
(45) Date of Patent: Jan. 11, 2022

(54) INTERNAL COMBUSTION ENGINE

(71) Applicant: TOYOTA JIDOSHA KABUSHIKI KAISHA, Toyota (JP)

(72) Inventor: Masami Ishikawa, Aichi-gun (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 196 days.

(21) Appl. No.: 16/573,283

(22) Filed: Sep. 17, 2019

(65) Prior Publication Data

US 2020/0141294 A1 May 7, 2020

(30) Foreign Application Priority Data

Nov. 5, 2018 (JP) ..... 2018-208143

(51) Int. Cl.

| | |
|---|---|
| ***B01D 50/00*** | (2006.01) |
| ***F01M 13/04*** | (2006.01) |
| ***F02F 7/00*** | (2006.01) |
| *F01M 11/00* | (2006.01) |

(52) U.S. Cl.

CPC ..... *F01M 13/04* (2013.01); *F02F 7/0082* (2013.01); *F01M 2011/0033* (2013.01)

(58) Field of Classification Search

CPC ..... F01M 13/04; F01M 13/022; F02M 25/06
USPC ..... 55/385.3
See application file for complete search history.

(56) References Cited

U.S. PATENT DOCUMENTS 4,501,234 A * 2/1985 Toki ..... F01M 13/025 123/196 R
8,047,186 B2 * 11/2011 Shieh ..... F01M 13/04 123/572
2010/0126479 A1 5/2010 Shieh et al.

FOREIGN PATENT DOCUMENTS

JP 2002-106319 A 4/2002
JP 2014-084730 A 5/2014

* cited by examiner

*Primary Examiner* — Long T Tran
*Assistant Examiner* — James J Kim
(74) *Attorney, Agent, or Firm* — Oliff PLC

(57) ABSTRACT

In an internal combustion engine, an oil separator provided in a blowby gas passage is attached to a side wall of a cylinder block. A first communicating passage and a second communicating passage via which the inside of a crankcase is connected to the oil separator are formed in the cylinder block. An opening of the first communicating passage on the crankcase side and an opening of the second communicating passage on the crankcase side are placed to be distanced from the center of the crankcase in the extending direction of a crankshaft so as to sandwich the center of the crankcase. No passage via which the inside of the crankcase is connected to the oil separator is provided between the first communicating passage and the second communicating passage.

4 Claims, 4 Drawing Sheets

INTERNAL COMBUSTION ENGINE

INCORPORATION BY REFERENCE

The disclosure of Japanese Patent Application No. 2018-208143 filed on Nov. 5, 2018 including the specification, drawings and abstract is incorporated herein by reference in its entirety.

BACKGROUND

1. Technical Field

The disclosure relates to an internal combustion engine.

2. Description of Related Art

Japanese Unexamined Patent Application Publication No. 2014-84730 (JP 2014-84730 A) describes an internal combustion engine configured such that an oil separator is attached to a side wall of a cylinder block. The cylinder block is provided with two communicating passages as passages via which the oil separator communicates with the inside of a crankcase, and an oil outlet port placed between the communicating passages. In this internal combustion engine, blowby gas inside the crankcase is introduced into the oil separator via the communicating passages, and oil separated in the oil separator is discharged via the oil outlet port.

SUMMARY

In an internal combustion engine in which an oil separator communicates with a crankcase, like the internal combustion engine described in JP 2014-84730 A, oil might flow back through a passage via which the oil separator communicates with the crankcase, so that the oil flows into the oil separator in some cases. When an inflow amount of the oil into the oil separator per time exceeds a discharge amount of the oil from the oil separator per time, the oil stays in the oil separator.

An internal combustion engine accomplished to solve the above problem is an internal combustion engine including: a cylinder block; a crankcase attached to a lower part of the cylinder block; an oil pan attached to a lower part of the crankcase; a cylinder head attached to an upper part of the cylinder block; a head cover configured to cover the cylinder head; a blowby gas passage via which blowby gas inside the crankcase is released to an air-intake passage; an oil separator provided in the blowby gas passage, the oil separator being attached to a side wall of the cylinder block; and a first communicating passage and a second communicating passage via which the inside of the crankcase is connected to the oil separator, the first communicating passage and the second communicating passage being formed in the cylinder block so as to constitute a part of the blowby gas passage. An opening of the first communicating passage on the crankcase side and an opening of the second communicating passage on the crankcase side are placed to be distanced from the center of the crankcase in the extending direction of a crankshaft so as to sandwich the center of the crankcase. No passage via which the inside of the crankcase is connected to the oil separator is provided between the first communicating passage and the second communicating passage.

The inventors of the disclosure found by measurement of a crankcase internal pressure that, inside a crankcase of an internal combustion engine during the operation, the internal pressure tends to be higher toward the central side in the extending direction of a crankshaft and the internal pressure tends to be lower as it is distanced from the center. As communicating passages via which the crankcase is connected to an oil separator, a communicating passage having an opening around the center inside the crankcase and a communicating passage having an opening at a position distanced from the center might be provided in some cases. In such a case, two communicating passages can serve as a circulation path via the oil separator due to the distribution of the internal pressure inside the crankcase as described above. When such a circulation path is formed, gas inside the crankcase is taken into the oil separator from the communicating passage having the opening near the center with a high pressure. Then, gas inside the oil separator is discharged into the crankcase through the communicating passage having the opening at a low-pressure position distanced from the center. Further, at this time, the oil might be sucked up through the communicating passage having the opening near the center with a high pressure, so that the oil might flow into the oil separator vigorously.

In view of this, in the above configuration, the first communicating passage and the second communicating passage are provided to be distanced from the center of the crankcase in the extending direction of the crankshaft so as to sandwich the center. No passage via which the inside of the crankcase is connected to the oil separator is provided between the first communicating passage and the second communicating passage. That is, the first communicating passage and the second communicating passage are provided to be distanced from the center where the internal pressure is high, so that a pressure difference between parts where these passages are opened is small in comparison with a case where one of the communicating passages is provided in the center. Accordingly, with the above configuration, even if the first communicating passage and the second communicating passage form a circulation path via the oil separator, the airflow in the circulation path is weak in comparison with a case where one of the communicating passages is provided in the center. Hereby, an inflow amount of the oil into the oil separator through the communicating passages can be reduced. Eventually, it is possible to restrain such a situation that the oil that cannot be discharged from the oil separator when the oil flows into the oil separator from the inside of the crankcase stays inside the oil separator.

The internal combustion engine of the above aspect may include a ventilation passage via which the inside of the head cover communicates with the inside of the crankcase, the ventilation passage being formed in the cylinder block. The ventilation passage may be provided between the first communicating passage and the second communicating passage in the extending direction.

With the above configuration, fresh air can be introduced into the vicinity of the center of the crankcase via the ventilation passage. The fresh air thus introduced expands inside the crankcase so as to be directed toward the first communicating passage and the second communicating passage placed to sandwich the ventilation passage in the extending direction of the crankshaft. The blowby gas inside the crankcase is introduced into the oil separator via the first communicating passage and the second communicating passage. On this account, in comparison with a case where the ventilation passage is provided in a part distanced from the center of the crankcase, the fresh air easily expands over the whole crankcase, thereby making it possible to ventilate the crankcase effectively.

In the internal combustion engine of the above aspect, when, among side walls of the cylinder block, a first side wall on a side where the oil separator is attached is taken as a first wall portion and a second side wall is taken as a second wall portion, an opening of the ventilation passage on the crankcase side may be placed on a side closer to the first wall portion than an intermediate point between the first wall portion and the second wall portion. The internal combustion engine may be provided with a posture inclined such that the first wall portion is placed vertically above the second wall portion.

In the above configuration, the opening of the ventilation passage is provided on the side closer to the first wall portion placed on the upper side in the vertical direction in a posture obtained when the internal combustion engine is provided in a vehicle. Accordingly, in comparison with a case where the opening is provided on a side closer to the second wall portion, the liquid surface of the oil is distanced from the opening of the ventilation passage. On this account, it is possible to restrain the fresh air gushing out of the opening of the ventilation passage from ruffling up the liquid surface of the oil, thereby making it possible to restrain the occurrence of air bubbles.

In the internal combustion engine of the above aspect, the cylinder block may include a plurality of cylinder bores arranged in the extending direction, and a plurality of bearing portions provided such that respective bearings configured to pivotally support journal portions of the crankshaft are formed in the bearing portions, the bearing portions being provided such that each of the cylinder bores is sandwiched between corresponding bearing portions in the extending direction. Among the bearing portions, two bearing portions placed to be distanced from the center of the crankcase in the extending direction so as to sandwich the center of the crankcase may be configured such that the first communicating passage is provided in one of the two bearing portions, and the second communicating passage is provided in the other one of the two bearing portions. The ventilation passage may be formed in the bearing portion placed between the bearing portion where the first communicating passage is provided and the bearing portion where the second communicating passage is provided.

With such a configuration, it is possible to achieve an internal combustion engine including a ventilation passage via which fresh air can be introduced into the vicinity of the center of a crankcase, and a first communicating passage and a second communicating passage that can reduce an inflow amount of oil into an oil separator.

In the internal combustion engine of the above aspect, the cylinder block may include four cylinder bores arranged in the extending direction. Among the bearing portions, a second bearing portion from one end in the extending direction may be provided with the first communicating passage, a third bearing portion from the one end may be provided with the ventilation passage, and a fourth bearing portion from the one end may be provided with the second communicating passage. By employing such a configuration, it is possible to achieve an internal combustion engine including a ventilation passage via which fresh air can be introduced into the vicinity of the center of a crankcase, and a first communicating passage and a second communicating passage that can reduce an inflow amount of oil into an oil separator.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Figure 1:
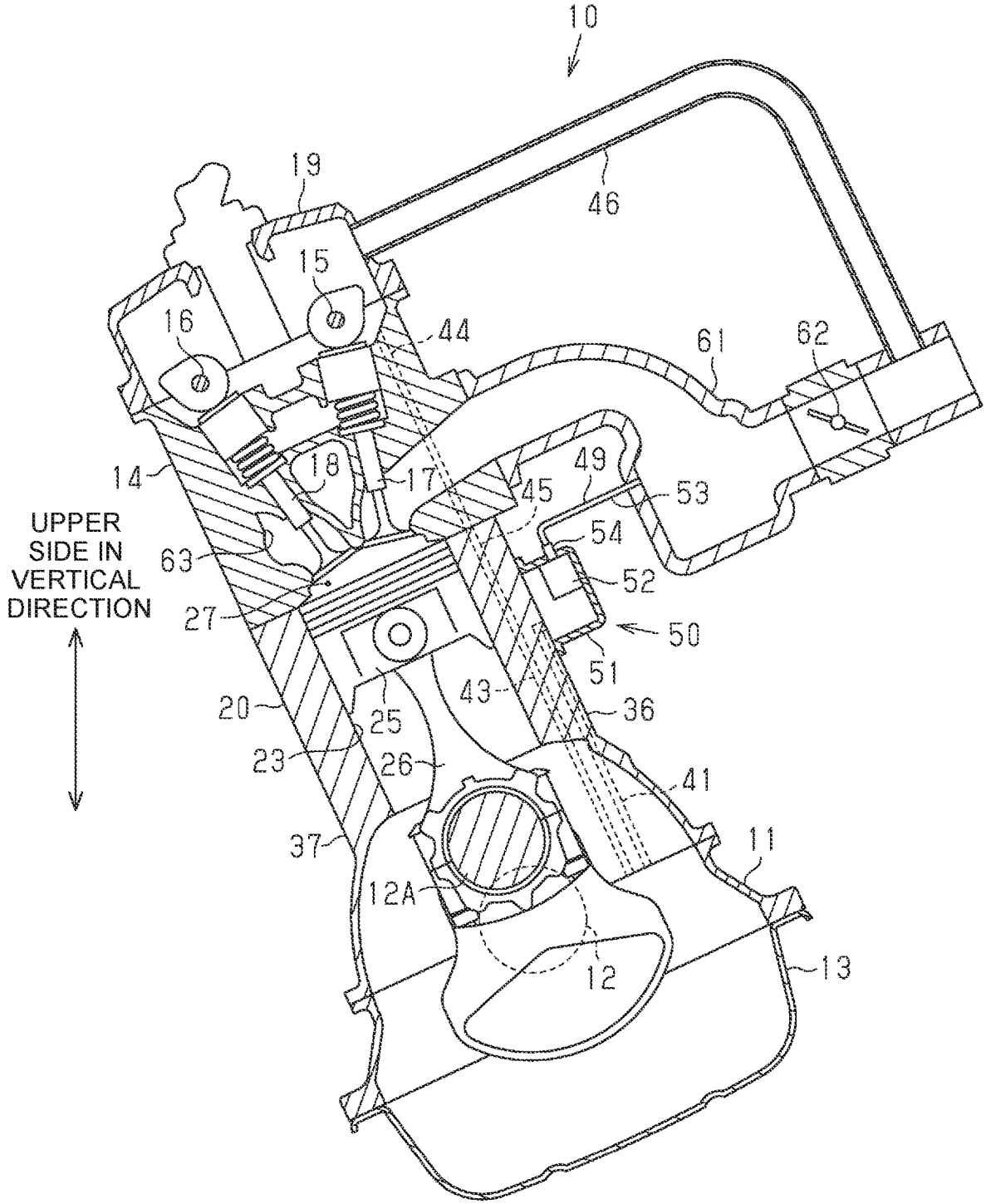
FIG. 1 is a sectional view illustrating one embodiment of an internal combustion engine.

The following describes one embodiment of an internal combustion engine with reference to FIGS. 1 to 5. As illustrated in FIG. 1, an internal combustion engine 10 includes a cylinder block 20 in which cylinder bores are formed. The internal combustion engine 10 is an inline-four-cylinder internal combustion engine, and four cylinder bores are formed in the cylinder block 20. In FIG. 1, a third cylinder bore 23 is illustrated as one of the four cylinder bores. A piston 25 reciprocatable in conjunction with a rotation of a crankshaft 12 is accommodated in each cylinder bore. The piston 25 is connected to the crankshaft 12 via a connecting rod 26 connected to a crankpin 12A of the crankshaft 12.

The internal combustion engine 10 includes a crankcase 11 attached to a lower part of the cylinder block 20. The internal combustion engine 10 includes an oil pan 13 attached to a lower part of the crankcase 11. Oil is accumulated in the oil pan 13 used for lubrication of each part of the internal combustion engine 10 and a hydraulic drive mechanism.

The internal combustion engine 10 includes a cylinder head 14 attached to an upper part of the cylinder block 20. An air-intake valve 17 and an air-discharge valve 18 of the internal combustion engine 10 are provided in the cylinder head 14. Further, an air-intake camshaft 15 for driving the air-intake valve 17 and an air-discharge camshaft 16 for driving the air-discharge valve 18 are attached to the cylinder head 14. The internal combustion engine 10 includes a head cover 19 attached to the cylinder head 14. The head cover 19 covers the air-intake camshaft 15 and the air-discharge camshaft 16.

The internal combustion engine 10 includes a combustion chamber 27 sectioned by the cylinder bore, the piston 25, and the cylinder head 14. The internal combustion engine 10 includes an air-intake passage 61 via which intake air is introduced into the combustion chamber 27. The internal combustion engine 10 includes an air-discharge passage 63 via which fuel/air mixture burnt in the combustion chamber 27 is discharged as a discharge gas.

A throttle valve 62 is provided in the air-intake passage 61 of the internal combustion engine 10. The internal combustion engine 10 includes a fresh-air introduction passage 46 via which a part of the air-intake passage 61 on the upstream side from the throttle valve 62 is connected to the head cover 19.

The internal combustion engine 10 includes a ventilation passage 45 via which the inside of the crankcase 11 communicates with the inside of the head cover 19. The ventilation passage 45 extends in the moving direction of the piston 25. The ventilation passage 45 is constituted by a block-side ventilation passage 43 formed in the cylinder block 20 and a head-side ventilation passage 44 formed in the cylinder head 14. A passage through which the intake air inside the air-intake passage 61 can be introduced into the crankcase 11 is constituted by the fresh-air introduction passage 46, a space inside the head cover 19, and the ventilation passage 45.

The internal combustion engine 10 includes a blowby gas passage 49 via which blowby gas inside the crankcase 11 is released to the air-intake passage 61. An oil separator 50 configured to separate oil contained in the blowby gas is provided in the blowby gas passage 49.

The oil separator 50 is attached to a first wall portion 36 that is a side wall of the cylinder block 20. The oil separator 50 includes a body 51 attached to the first wall portion 36 and a separation portion 52 accommodated between the body 51 and the first wall portion 36. The separation portion 52 has a labyrinth structure, for example, and is configured to separate the oil by causing the blowby gas to hit the separation portion 52. The oil separator 50 is connected to a part of the air-intake passage 61 on the downstream side from the throttle valve 62 via a release passage 53. A PCV valve 54 configured to open and close the release passage 53 is provided in the release passage 53. A space between the body 51 and the first wall portion 36 is connected to the inside of the crankcase 11 via communicating passages formed in the cylinder block 20. FIG. 1 illustrates a first communicating passage 41 among the communicating passages. The first communicating passage 41 extends in the moving direction of the piston 25.

When the internal pressure of the oil separator 50 becomes higher than the internal pressure of the air-intake passage 61, the PCV valve 54 opens. Hereby, the blowby gas is released to the air-intake passage 61 via the release passage 53. That is, when the internal pressures of the crankcase 11 and the oil separator 50 communicating with the crankcase 11 increase due to the blowby gas leaking into the crankcase 11 from the combustion chamber 27, the blowby gas that has passed through the release passage 53 is introduced into the air-intake passage 61. The blowby gas passage 49 is constituted by the communicating passages via which the crankcase 11 is connected to the oil separator 50, the oil separator 50, the release passage 53, and the PCV valve 54. When the blowby gas is released from the release passage 53, the intake air is introduced into the head cover 19 via the fresh-air introduction passage 46. The intake air introduced into the head cover 19 passes through the ventilation passage 45 and is introduced into the crankcase 11.

In FIG. 1, an arrow indicative of the vertical direction is illustrated. The internal combustion engine 10 is provided in a vehicle with an inclined posture as illustrated in FIG. 1. In this posture, the first wall portion 36 that is a side wall of the cylinder block 20 on a side where the oil separator 50 is attached is placed vertically above a second wall portion 37 that is a second side wall of the cylinder block 20.

Figure 2:
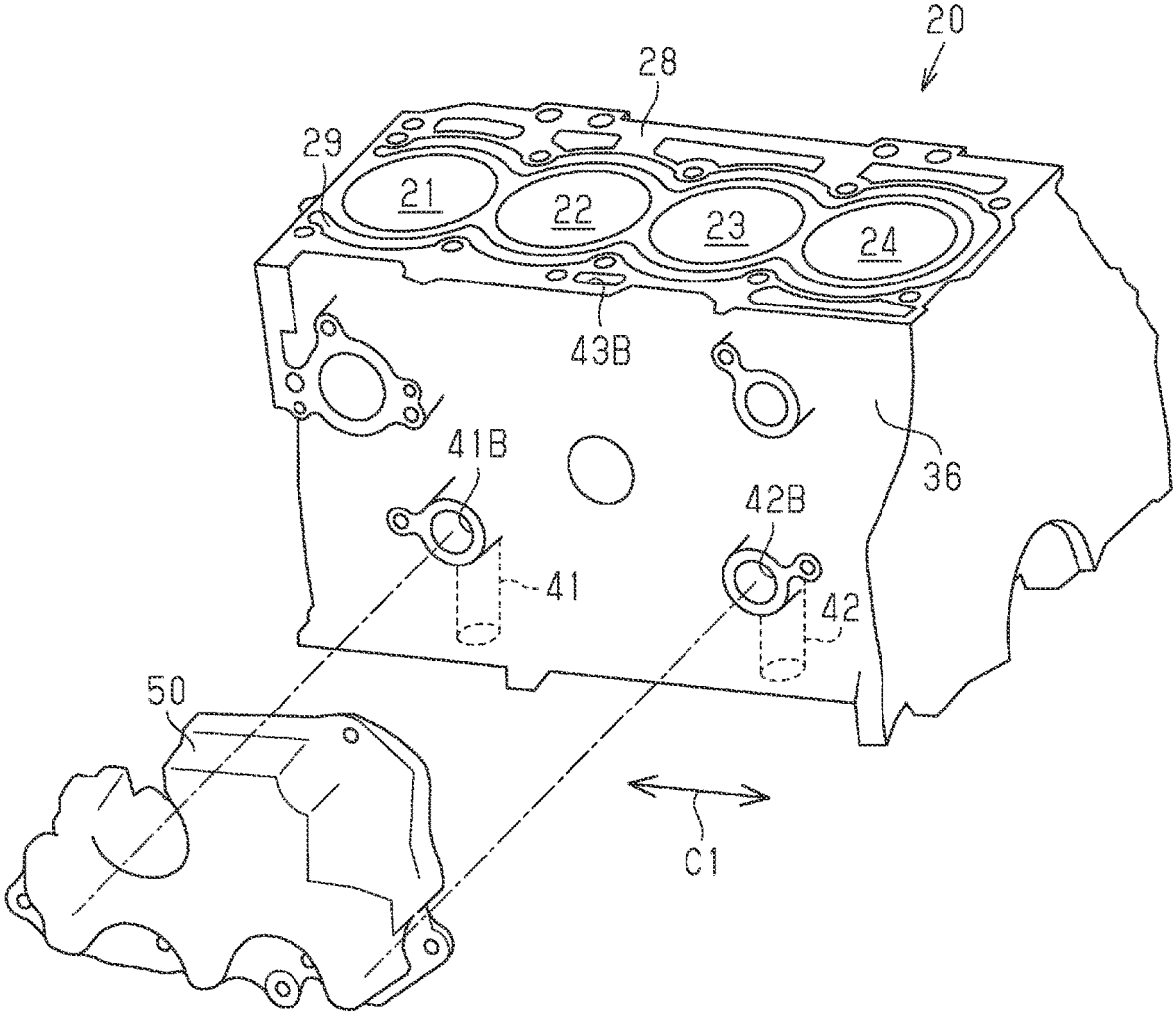
FIG. 2 is a perspective view illustrating a cylinder block provided in the internal combustion engine according to the embodiment.
Figure 3:
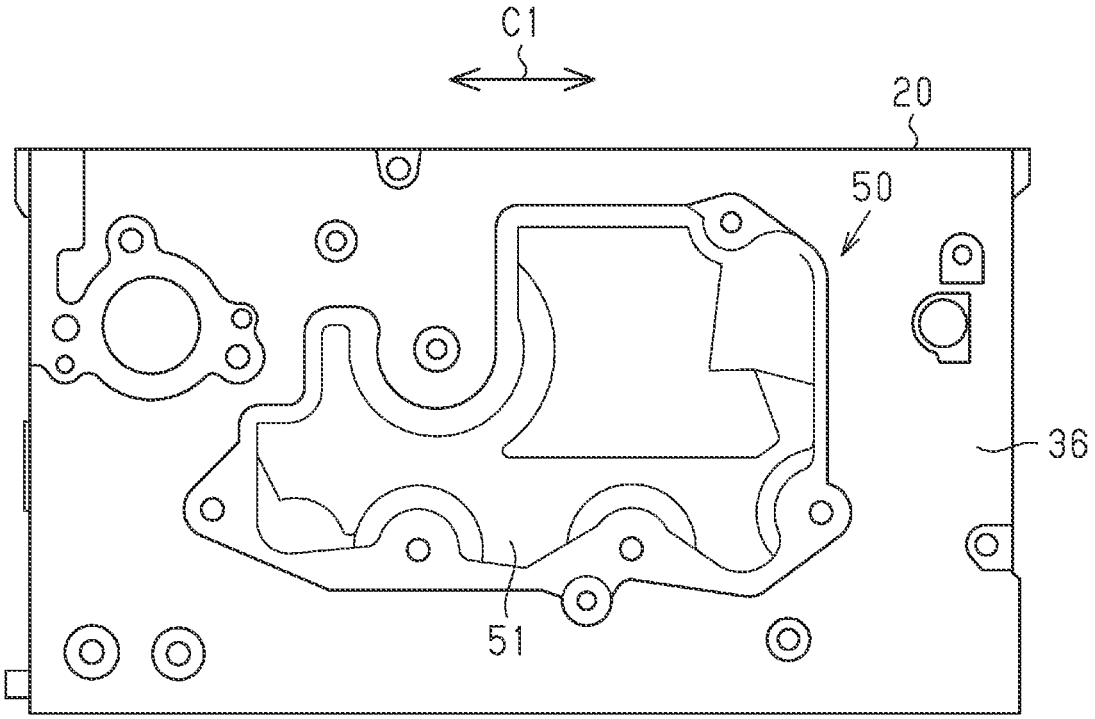
FIG. 3 is a front view illustrating the cylinder block provided in the internal combustion engine according to the embodiment.

The cylinder block 20 and the oil separator 50 are illustrated in FIGS. 2 and 3. As illustrated in FIG. 2, the cylinder bores are opened on a deck surface 28 that is a surface of the cylinder block 20 on the cylinder head 14 side. In the cylinder block 20, four cylinder bores, i.e., a first cylinder bore 21, a second cylinder bore 22, the third cylinder bore 23, and a fourth cylinder bore 24 are arranged sequentially in this order from the left side in FIG. 2. A water jacket 29 is formed around the first cylinder bore 21 to the fourth cylinder bore 24. Further, an opening 43B that is an opening of the block-side ventilation passage 43 on the cylinder head 14 side is formed on the deck surface 28. The block-side ventilation passage 43 is formed at a position farther from the cylinder bores than the water jacket 29.

The first communicating passage 41 and a second communicating passage 42 are formed in the cylinder block 20 as the communicating passages via which the inside of the crankcase 11 is connected to the oil separator 50. An opening 41B that is an opening of the first communicating passage 41 on the oil separator 50 side is formed in the first wall portion 36. An opening 42B that is an opening of the second communicating passage 42 on the oil separator 50 side is formed in the first wall portion 36. The opening 41B of the first communicating passage 41 and the opening 42B of the second communicating passage 42 are opened at positions distanced from each other in the arrangement direction where the first cylinder bore 21 to the fourth cylinder bore 24 are arranged, that is, in the extending direction of the crankshaft 12. In FIG. 2, an extending direction C1 is illustrated as the extending direction of the crankshaft 12.

As illustrated in FIGS. 2 and 3, the oil separator 50 is attached at a position, in the extending direction C1, over a part where the second cylinder bore 22 is formed and a part where the third cylinder bore 23 is formed in the cylinder block 20. In a state where the oil separator 50 is attached to the first wall portion 36 of the cylinder block 20, the openings 41B, 42B are covered with the body 51 and are placed inside the oil separator 50.

Figure 4:
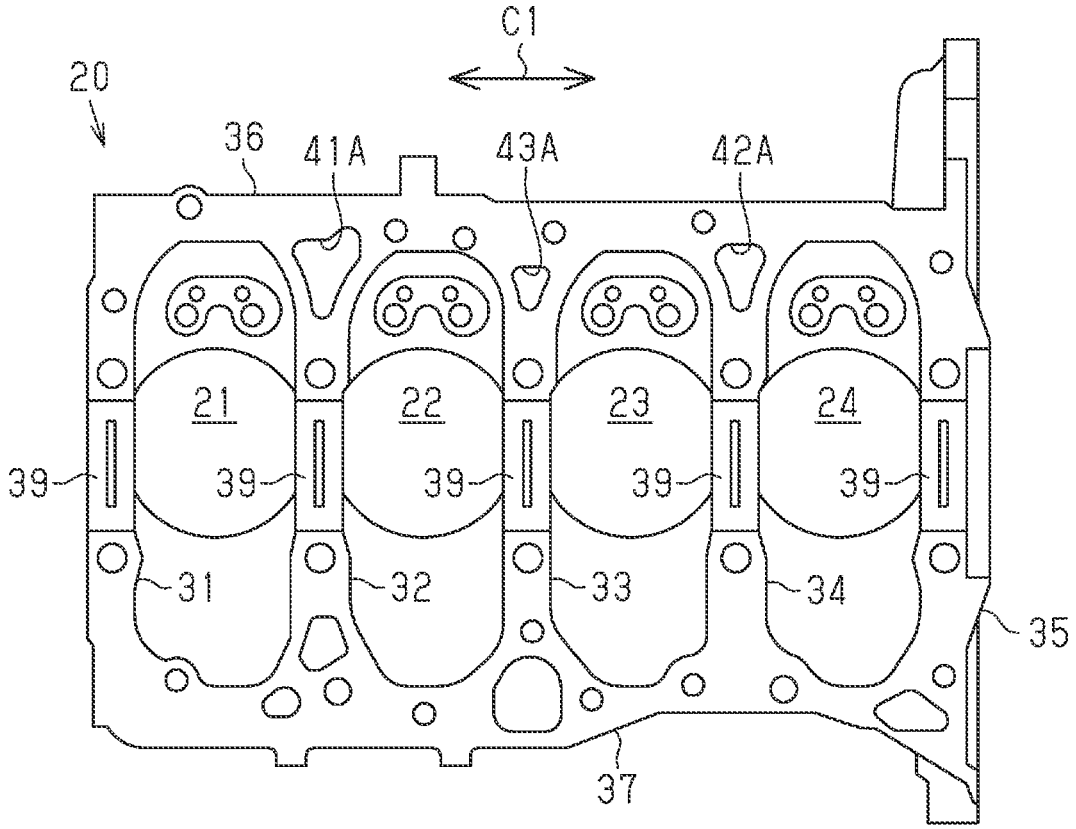
FIG. 4 is a view illustrating a crankcase-side surface of the cylinder block provided in the internal combustion engine according to the embodiment.

FIG. 4 illustrates a surface of the cylinder block 20 on the crankcase 11 side. The cylinder block 20 includes journal bearings 39 pivotally supporting journal portions of the crankshaft 12. The journal bearings 39 are formed in bearing portions via which the first wall portion 36 and the second wall portion 37 of the cylinder block 20 are connected to each other. The cylinder block 20 in which four cylinder bores are formed includes a first bearing portion 31 to a fifth bearing portion 35 as the bearing portions. The first cylinder bore 21 is sandwiched between the first bearing portion 31 and the second bearing portion 32 in the extending direction C1. The second cylinder bore 22 is sandwiched between the second bearing portion 32 and the third bearing portion 33 in the extending direction C1. The third cylinder bore 23 is sandwiched between the third bearing portion 33 and the fourth bearing portion 34 in the extending direction C1. The fourth cylinder bore 24 is sandwiched between the fourth bearing portion 34 and the fifth bearing portion 35 in the extending direction C1.

An opening 41A that is an opening of the first communicating passage 41 on the crankcase 11 side is formed in the second bearing portion 32. An opening 42A that is an opening of the second communicating passage 42 on the crankcase 11 side is formed in the fourth bearing portion 34. An opening 43A that is an opening of the block-side ventilation passage 43 on the crankcase 11 side is formed in the third bearing portion 33 provided between the second bearing portion 32 and the fourth bearing portion 34. The opening 41A of the first communicating passage 41, the opening 42A of the second communicating passage 42, and the opening 43A of the block-side ventilation passage 43 are provided in respective connection portions of the bearing portions 32, 33, 34 with the first wall portion 36. That is, the opening 41A of the first communicating passage 41, the opening 42A of the second communicating passage 42, and the opening 43A of the block-side ventilation passage 43 are placed on a side closer to the first wall portion 36 than an intermediate point between the first wall portion 36 and the second wall portion 37.

Figure 5:
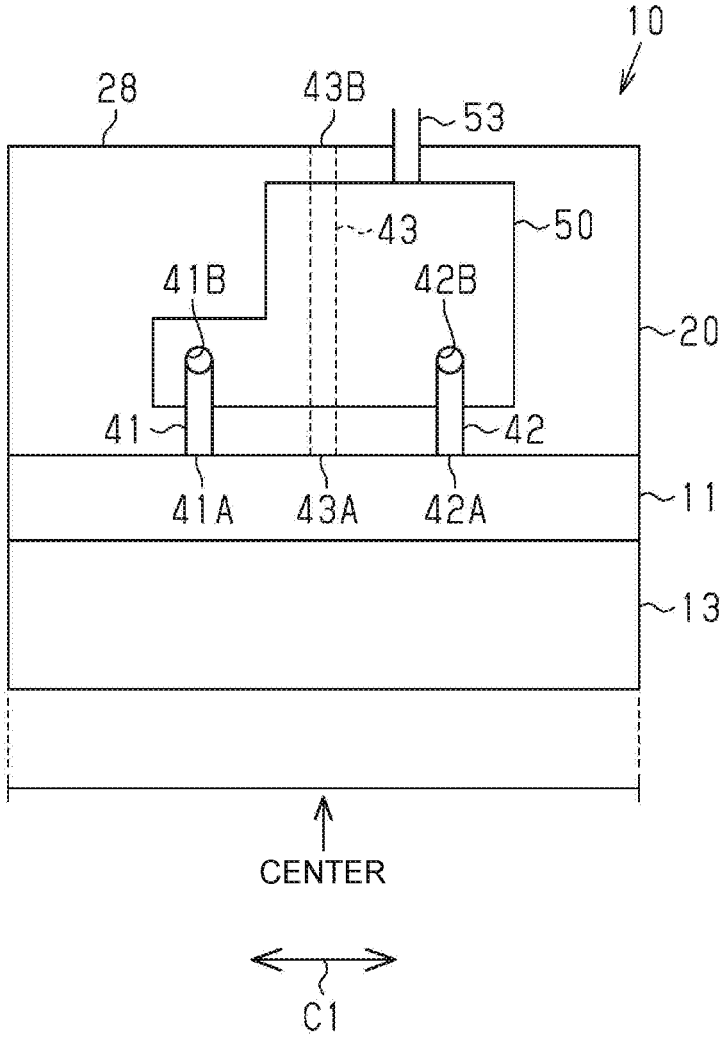
FIG. 5 is a view schematically illustrating passages connected to an oil separator provided in the internal combustion engine according to the embodiment.

In FIG. 5, the internal combustion engine 10 is illustrated schematically. The opening 43A, of the block-side ventilation passage 43, that is formed in the third bearing portion 33 of the cylinder block 20 is placed around the center of the crankcase 11 in the extending direction C1. The block-side ventilation passage 43 extends in the moving direction of the piston 25, and the opening 43B that is the other opening is placed on the deck surface 28. The block-side ventilation passage 43 does not communicate with the oil separator 50.

The opening 41A, of the first communicating passage 41, that is formed in the second bearing portion 32 of the cylinder block 20 is distanced from the center of the crankcase 11 in the extending direction C1. Similarly, the opening 42A, of the second communicating passage 42, that is formed in the fourth bearing portion 34 of the cylinder block 20 is distanced from the center of the crankcase 11 in the extending direction C1. The opening 41A formed in the second bearing portion 32 and the opening 42A formed in the fourth bearing portion 34 are provided at positions that sandwich the center of the crankcase 11. The first communicating passage 41 and the second communicating passage 42 extend in the moving direction of the piston 25, and the openings 41B, 42B are placed inside the oil separator 50. The first communicating passage 41 and the second communicating passage 42 are placed to sandwich the block-side ventilation passage 43 in the extending direction C1 of the crankshaft 12.

The release passage 53 is connected to the oil separator 50 in a part between the block-side ventilation passage 43 and the second communicating passage 42 in the extending direction C1. Next will be described operations and effects of the present embodiment.

In the internal combustion engine 10 of the present embodiment, the first communicating passage 41 and the second communicating passage 42 are provided to be distanced from the center of the crankcase 11 in the extending direction C1 of the crankshaft 12 such that the center of the crankcase 11 in the extending direction C1 is sandwiched between the first communicating passage 41 and the second communicating passage 42. No passage via which the inside of the crankcase 11 is connected to the oil separator 50 is provided between the first communicating passage 41 and the second communicating passage 42. That is, the first communicating passage 41 and the second communicating passage 42 are provided to be distanced from the center where the internal pressure is high, so that a pressure difference between parts where these passages are opened is small in comparison with a case where one of the communicating passages is provided in the center. Further, in the internal combustion engine 10, the release passage 53 via which the blowby gas is released from the oil separator 50 is provided closer to the second communicating passage 42 than the first communicating passage 41. On this account, the internal pressure of the second communicating passage 42 easily decreases in comparison with the first communicating passage 41. Such a pressure difference between the first communicating passage 41 and the second communicating passage 42 easily causes a circulation path in which gas inside the crankcase 11 flows into the oil separator 50 through the first communicating passage 41 and is then discharged from the oil separator 50 through the second communicating passage 42. Hereby, the oil inside the oil separator 50 can be returned to the crankcase 11 side through this circulation path.

The first communicating passage 41 and the second communicating passage 42 constituting the circulation path are distanced from the center of the crankcase 11 in the extending direction C1, so that the airflow in the circulation path is weak in comparison with a case where one of the communicating passages is provided in the center where the internal pressure tends to be high. Hereby, an inflow amount of the oil into the oil separator 50 through the first communicating passage 41 can be reduced. Eventually, it is possible to restrain such a situation that the oil that cannot be discharged from the oil separator 50 when the oil flows into the oil separator 50 from the inside of the crankcase 11 stays inside the oil separator 50.

For example, in a case where the operating state of the internal combustion engine 10 is a heavy-load and high-rotation state, air bubbles, of the oil, that are caused when the oil accumulated in the oil pan 13 is stirred by the crankshaft 12 might be formed in an air-bubble layer and float on a liquid surface of the oil. In such a state, the oil easily flows into the oil separator 50 from the inside of the crankcase 11 via the first communicating passage 41 and the second communicating passage 42 communicating with the oil separator 50. In the internal combustion engine 10, since the first communicating passage 41 and the second communicating passage 42 communicating with the oil separator 50 are distanced from the center of the crankcase 11 in the extending direction C1, a vigorous flow of the oil flowing into the oil separator 50 from the crankcase 11 side can hardly be formed. That is, the inflow amount of the oil into the oil separator 50 can be reduced.

Further, in the internal combustion engine 10, the opening 43A of the block-side ventilation passage 43 is placed in the center of the crankcase 11 in the extending direction C1. On this account, the fresh air can be introduced into the vicinity of the center of the crankcase 11 via the ventilation passage 45. Accordingly, the fresh air thus introduced easily expands inside the crankcase 11 so as to be directed toward the first communicating passage 41 and the second communicating passage 42 placed to sandwich the block-side ventilation passage 43 in the extending direction C1 of the crankshaft 12. On this account, in comparison with a case where the block-side ventilation passage 43 is provided in a part distanced from the center of the crankcase 11, the fresh air easily expands over the whole crankcase 11, thereby making it possible to ventilate the crankcase 11 effectively.

Further, in the internal combustion engine 10, the opening 43A of the block-side ventilation passage 43 is provided on the side closer to the first wall portion 36 placed on the upper side in the vertical direction in a posture obtained when the internal combustion engine 10 is provided in the vehicle. On this account, in comparison with a case where the opening 43A is provided on a side closer to the second wall portion 37, the liquid surface of the oil is distanced from the opening 43A of the block-side ventilation passage 43. Accordingly, it is possible to restrain the fresh air gushing out of the opening 43A of the block-side ventilation passage 43 from ruffling up the liquid surface of the oil, thereby making it possible to restrain the occurrence of air bubbles. The restraint of the occurrence of air bubbles can restrain deterioration of the oil.

Further, in the internal combustion engine 10, the opening 41A of the first communicating passage 41 and the opening 42A of the second communicating passage 42 are provided on the side closer to the first wall portion 36 placed on the upper side in the vertical direction in the posture obtained when the internal combustion engine 10 is provided in the vehicle. On this account, in comparison with a case where the opening 41A and the opening 42A are provided on the side closer to the second wall portion 37, the liquid surface of the oil is distanced from the opening 41A of the first communicating passage 41 and the opening 42A of the second communicating passage 42. Accordingly, the oil can hardly flow into the first communicating passage 41 via the opening 41A. Similarly, the oil can hardly flow into the second communicating passage 42 via the opening 42A. Hereby, the inflow amount of the oil into the oil separator 50 can be reduced.

The present embodiment can be also carried out by adding changes as stated below. The present embodiment and the following modifications can be carried out in combination as long as they do not cause any technical inconsistencies.—The above embodiment deals with the inline-four-cylinder internal combustion engine 10, but the number of cylinders provided in the internal combustion engine can be any given number. When the oil separator 50 communicates with the crankcase 11 so as to avoid the center, in the extending direction C1, that tends to be high in internal pressure, it is possible to yield an effect to reduce the inflow amount of the oil into the oil separator 50 from the crankcase 11, similarly to the above embodiment.

—In the above embodiment, FIG. 1 illustrates an inclined posture when the internal combustion engine 10 is provided in the vehicle, but the inclination angle can be modified appropriately. Further, the configuration where the mounting posture of the internal combustion engine 10 inclines is not a necessary configuration.

—In the above embodiment, the block-side ventilation passage 43 is provided on the side closer to the first wall portion 36, but the block-side ventilation passage 43 may be formed on the side closer to the second wall portion 37.—In the above embodiment, the block-side ventilation passage 43 is placed between the first communicating passage 41 and the second communicating passage 42, but the block-side ventilation passage 43 may not be necessarily formed between the first communicating passage 41 and the second communicating passage 42.

—In the above embodiment, the openings 41A, 42A of the first communicating passage 41 and the second communicating passage 42 on the crankcase 11 side are formed in the bearing portions. The opening 41A of the first communicating passage 41 on the crankcase 11 side and the opening 42A of the second communicating passage 42 on the crankcase 11 side should be placed to be distanced from the center of the crankcase 11 in the extending direction of the crankshaft 12 across the center of the crankcase 11. That is, the openings 41A, 42A on the crankcase 11 side can be formed in parts other than the bearing portions. For example, the openings 41A, 42A on the crankcase 11 side may be formed in the first wall portion 36.

Also, in terms of the block-side ventilation passage 43, the opening 43A on the crankcase 11 side may be formed in a part other than the bearing portion. —In the above embodiment, the dimension of the oil separator 50 in the extending direction C1 is set to a size that covers the part where the second cylinder bore 22 is formed and the part where the third cylinder bore 23 is formed. The dimension and the shape of the oil separator 50 can be changed appropriately.

What is claimed is:

1. An internal combustion engine comprising:

a cylinder block;

a crankcase attached to a lower part of the cylinder block;

an oil pan attached to a lower part of the crankcase;

a cylinder head attached to an upper part of the cylinder block;

a head cover configured to cover the cylinder head;

a blowby gas passage via which blowby gas inside the crankcase is released to an air-intake passage;

an oil separator provided in the blowby gas passage, the oil separator being attached to a side wall of the cylinder block;

a first communicating passage and a second communicating passage via which an inside of the crankcase is connected to the oil separator, the first communicating passage and the second communicating passage being formed in the cylinder block so as to constitute a part of the blowby gas passage; and a ventilation passage via which an inside of the head cover communicates with the inside of the crankcase, the ventilation passage being formed in the cylinder block, wherein an opening of the first communicating passage on the crankcase side and an opening of the second communicating passage on the crankcase side are placed to be distanced from a center of the crankcase in an extending direction of a crankshaft so as to sandwich the center of the crankcase, wherein no passage via which the inside of the crankcase is connected to the oil separator is provided between the first communicating passage and the second communicating passage, and wherein the ventilation passage is provided between the first communicating passage and the second communicating passage in the extending direction.

2. The internal combustion engine according to claim 1, wherein:

when, among side walls of the cylinder block, a first side wall on a side where the oil separator is attached is taken as a first wall portion and a second side wall is taken as a second wall portion, an opening of the ventilation passage on the crankcase side is placed on a side closer to the first wall portion than an intermediate point between the first wall portion and the second wall portion; and the internal combustion engine is provided with a posture inclined such that the first wall portion is placed vertically above the second wall portion.

3. The internal combustion engine according to claim 1, wherein:

the cylinder block includes a plurality of cylinder bores arranged in the extending direction, and a plurality of bearing portions provided such that respective bearings configured to pivotally support journal portions of the crankshaft are formed in the bearing portions, the bearing portions being provided such that each of the cylinder bores is sandwiched between corresponding bearing portions in the extending direction;

among the bearing portions, two bearing portions placed to be distanced from the center of the crankcase in the extending direction so as to sandwich the center of the crankcase are configured such that the first communicating passage is provided in one of the two bearing portions, and the second communicating passage is provided in the other one of the two bearing portions; and the ventilation passage is formed in the bearing portion placed between the bearing portion where the first communicating passage is provided and the bearing portion where the second communicating passage is provided.

4. The internal combustion engine according to claim 3, wherein:

the cylinder block includes four cylinder bores arranged in the extending direction; and among the bearing portions, a second bearing portion from one end in the extending direction is provided with the first communicating passage, a third bearing portion from the one end is provided with the ventilation passage, and a fourth bearing portion from the one end is provided with the second communicating passage.

* * * * *